United States Patent [19]

George et al.

[11] 4,376,529

[45] Mar. 15, 1983

[54] OUTPUT STATION FOR REPRODUCING MACHINE

[75] Inventors: Clifford L. George, Macedon; Wayne R. Smith, Henrietta, both of N.Y.

[73] Assignee: Xerox Corporation, Stamford, Conn.

[21] Appl. No.: 135,600

[22] Filed: Mar. 31, 1980

[51] Int. Cl.[3] ..... B42B 2/00

[52] U.S. Cl. ..... 270/53

[58] Field of Search ..... 270/37, 53, 58; 271/251, 287, 292, 294–296

[56] References Cited

U.S. PATENT DOCUMENTS

| | | | |
|---|---|---|---|
| 3,516,654 | 6/1970 | Mestre | 271/292 |
| 3,708,160 | 1/1973 | Kantarian | 270/53 |
| 3,709,595 | 1/1973 | Turner | 270/53 |
| 3,995,748 | 12/1976 | Looney | 271/296 |
| 4,029,309 | 6/1977 | Lynch | 270/53 |
| 4,083,550 | 4/1978 | Pal | 270/53 |
| 4,087,087 | 5/1978 | Looney | 271/296 |
| 4,266,762 | 5/1981 | Kramer | 271/251 X |

OTHER PUBLICATIONS

IBM Technical Disclosure; vol. 18, No. 9, Feb. 1976, p. 2807; Cralle, W. O. et al., "Stapler Unloader for Copier".

IBM Technical Disclosure; vol. 18, No. 10, Mar. 1976, p. 3160, Miller, M. T., "Collator-Stapler Module for Copier".

*Primary Examiner*—Edgar S. Burr
*Assistant Examiner*—A. Heinz

[57] ABSTRACT

A finishing station for a reproducing machine provides for the collecting, sorting, corner registration of collated sets, finishing as by stapling or other means and the collection of collated sets. In particular, the sorter comprises a plurality of copy sheet collating trays arranged in a vertical array, means to transport copy sheets from the reproducing machine to the sorter, corner registration means for the collated sets within the tray, means to maintain the corner registration of the collated copy sheets as they are transported while in the tray to a finishing station, a finishing station and a finished collated set collection station.

8 Claims, 7 Drawing Figures

OUTPUT STATION FOR REPRODUCING MACHINE

BACKGROUND OF THE INVENTION

This invention relates to a finishing station for a reproducing machine and in particular to a station which includes a collating sorter for individual copy sheets, a device for finishing or securing in a finished set the individual sheets of a collated set and a means of collecting the individual finished collated sets.

This invention is particularly adapted for use with an automatic copying machine wherein reproduction of multipage original documents or sets are made by sequentially making the desired number of copies of the first page in the set, collecting the copies in individual trays or bins and thereafter sequentially making the desired number of copies of the second and subsequent pages of the set.

With the continued development of the xerographic reproduction apparatus including those capable of operating at higher speeds it has become desirable to automatically process or handle the copies produced from the machine. The desire has been particularly felt for obtaining fully collated and finished sets of copies from a collated original set of several pages. Traditionally there have been two ways of achieving this result.

The finished collated sets may be made as a set one at a time by copying each page of the original only once and collecting the copies produced from the reproducing machine. For each copy of a collated set desired the original pages of the set are sequentially copied and the individual copies collected. If performed manually this is a very laborious and time consuming procedure. To facilitate this type of copying, automatic or semi automatic devices for handling or transporting the individual sheets of the original set onto and back off of the imaging platen have been used. While these document handlers may minimize the need for operator involvement they are typically rather costly and complex to maintain for efficient operation. They also suffer the disadvantage in that each time an original document is physically handled by some mechanical device the possibility of damage to the original document exists. Furthermore with some devices the cumulative effect of repeated handling of a document for each copy that is desired may result in the increased probability of damage to the original for each successive handling.

The second way of obtaining collated sets of multipage original documents is to make the total desired number of copies of each page at the same time and collect them in individual collecting bins. Thus if ten copies of a five page original set are desired, the first page of the original set is placed on the platen and ten copies of it are made, each copy being delivered to a collecting device which typically comprises an array of bins connected to the output end of a reproducing machine. Thereafter ten copies each of pages two thru five are made and the copies collected in the bins.

The next step in the development of the use of the xerographic process was the desire to finish the collated sets by stapling, stitching, binding, etc. the individual sheets. For this process the collated sets have typically been physically removed from the bins and transported to the finishing device. Initially the collated sets were manually removed from the collecting bins by the operator. Subsequently mechanical devices were devised to physically move the collated sets from the bins. With both of these techniques the possibility of the collated sets being presented to the finishing station with the individual sheets in the set not in perfect registration exists. Indeed, it is almost inevitable that some jogging of the collated set to obtain registration along at least one edge is necessary. In addition, with multisheet sets the probability of one of more sheets being out of registration is increased with the number of sheets in the set. In view of these difficulties there continues to be a desire to collect the individual sheets in the collecting bins, register the sheets in the bins and finish the sheets in the bins without human interference.

DESCRIPTION OF THE PRIOR ART

U.S. Pat. No. 4,083,550 to Pal describes a sorting and finishing apparatus for use with a copying machine. The sorter includes a plurality of bins or trays for stacking individual sheets as they are delivered from the copying machine. The trays are attached to a rack which moves up and down in a fixed guide member to facilitate insertion of the sheets in the trays. Each of the trays are attached to the rack such that they make an angle of about 15° to the horizontal. At the completion of sorting sheets for the first individual tray in the sorter a yoke mechanism is moved into engagement with the tray and causes the tray to move forward out of the tray guide to be placed on a smooth surface platform where the sheets in the tray are punched and stapled following which the sheets, which cling to the punch device, are disengaged from the punch and pushed downward onto the smooth platform and into a collecting bin. After the first tray has been emptied in this way it is returned to its original position and the second tray receives its final copy and is moved by the yoke mechanism in the same manner as the first tray.

SUMMARY OF THE INVENTION

In accordance with this invention a novel finishing station for a reproducing machine is provided. In particular this apparatus provides for the collecting and sorting of the individual sheets of a multipage original set, the corner registration of the sets, the finishing of the collected and registered set while in the sheet collecting tray and the collection of the finished set.

More particularly the present invention is directed to a finishing station for a reproducing machine comprising a sorter which includes a plurality of copy sheet collecting trays arranged in a vertical array, means to transport copy sheets from the reproducing machine to the sorter, corner registration means for the collated copy sheets within the tray, means to maintain the corner registration of the collated copy sheets as they are transported while in the tray to a finishing station, a collated set finishing station and a finished collated set collection station.

In a specific aspect of the invention the trays are pivotly mounted and moved from the copy sheet sorting position to the finishing station through an arc while maintaining the corner registration of the sheets, the corner registration being maintained by a sheet aligner mechanism.

Accordingly it is an object of the present invention to corner register individual sheets of a collated set of sheets in a sheet collection tray of a sorter.

It is a further object of the present invention to maintain the corner registration of the collated sets in the sheet collecting tray as the tray is moved from a sorting position to a finishing position.

It is an additional object of the present invention to automatically collate into sets copy sheets of a multipage document, register these copy sheets, finish the collated sets and collect the finished sets.

For a better understanding of the invention as well as other objects and further features thereof reference is had to the following drawings and description:

DESCRIPTION OF PREFERRED EMBODIMENT

Figure 1:
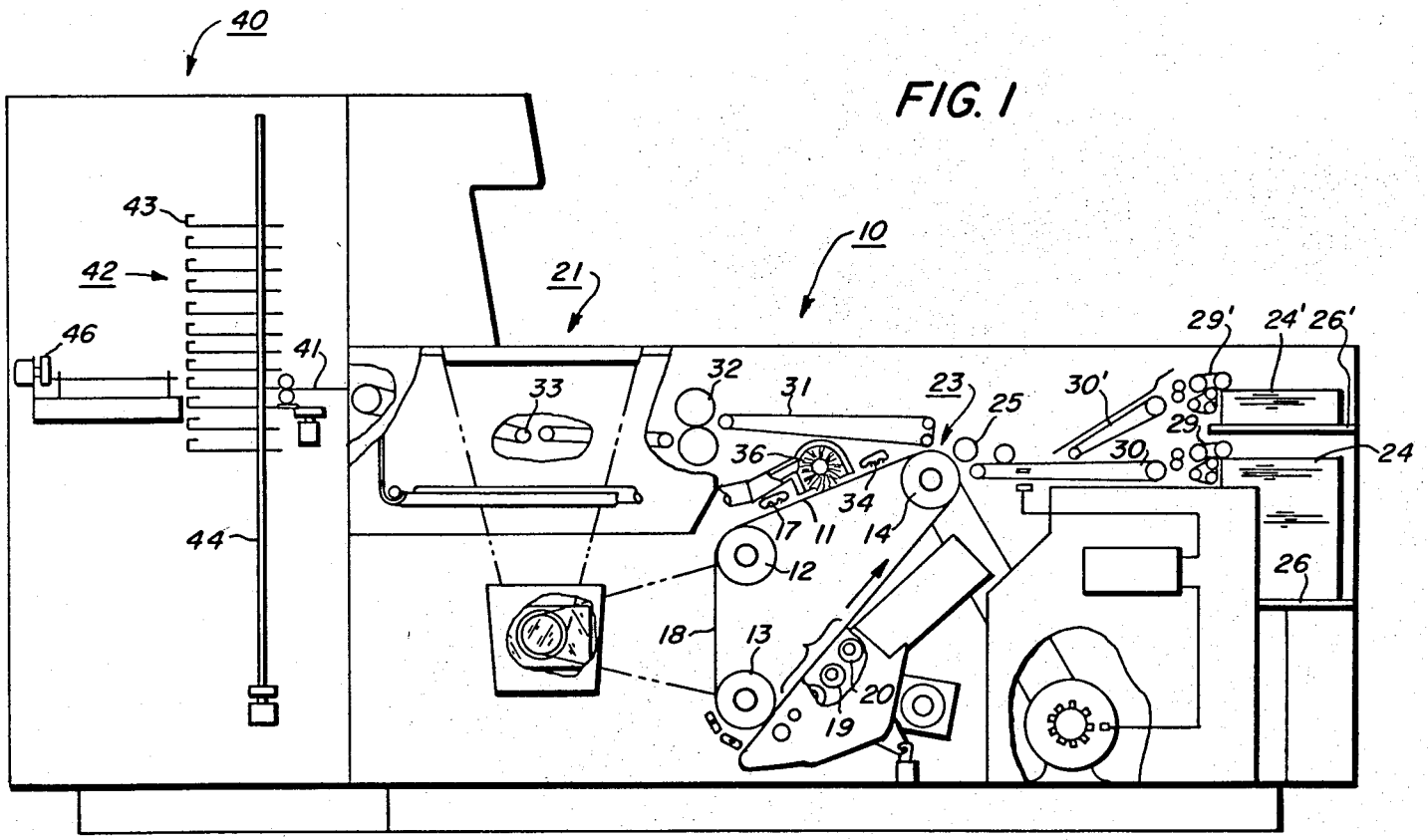
FIG. 1 is a schematic representation of an automatic xerographic reproducing apparatus with the finishing station of the present invention adjacent the copy output portion of the reproducing apparatus.

The invention will now be described by reference to a preferred embodiment of the finishing station. Referring now to FIG. 1 there is shown by way of example an automatic xerographic reproduction apparatus 10 which includes the finishing station of the present invention. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment or embodiments shown herein.

The reproduction apparatus 10, includes an electrically photosensitive member in the form of an endless belt or web 11, which is supported by three belt supporting rollers 12, 13, and 14. One of the belt supporting rollers is drivingly coupled to a suitable motor to move the belt in the direction shown by the solid line.

The surface of the moving belt 11 is uniformly charged by a suitable charging device such as corotron 17 in preparation for imaging. The charged surface of the belt moves through an exposure station 18 where the belt is exposed to a light image of the original 21 being copied, whereby the charge is selectively disipated in the light exposed regions to record the original input scene in the form of an electrostatic latent image.

The belt 11 with the electrostatic latent image is then carried past developing station 19 where a conventional developer mix is applied to the photoconductor belt 11 rendering the latent image visible. Typically the developer apparatus includes a plurality of developer rolls 20 which serve to bring the developer into proximity with the belt. The belt 11 bearing the developed image thereafter passes through transfer station 23 where the developed image is electrostatically transferred to transfer material such as copy sheet 24. To facilitate transfer of the developer in image configuration a biased transfer roll 25 is provided.

Copy sheets 24 which are stored in supply tray 26 are brought forward to transfer station 23 by conveyors 29, 30. An auxiliary supply of copy sheets 24 in the form of supply tray 26' may be provided. In that case additional conveyors 29', 30' are provided to advance sheets from the auxiliary supply tray 26'.

Following transfer the copy sheet 24, bearing the toner image is carried by a conveyor 31 to a suitable image fixing device such as fusing mechanism 32 where the toner image is permanently fixed to copy sheet 24. The finished copy sheet is thereafter transported by conveyor 33 to the finishing station 40.

Following transfer of the developed image therefrom belt 11 is reconditioned in preparation for re-imaging. In accordance therewith residual charges on belt 11 may be neutralized or reduced by means of preclean corotron 34 and thereafter the belt surface may be cleaned by a brush 36 which is preferably housed in an evacuated chamber which serves to draw off particulate material, normally toner, removed from the surface of belt 11 by brush 36.

The finishing station 40 includes edge registration transport 41 which transports sheets from the output area of the processor section of the reproduction apparatus to the sorting station 42 of the finishing station. Typically the individual copy sheets will be collated at the sorting station in a vertical array of bins 43. Following collation of the sheets in the bins 43 the individual bins 43 are pivoted about bin pivot 44 to stapler station 46 to enable the finishing of the collated sets. After the collated sets have been stapled and with additional reference to FIG. 2 the bins 43 pivot about bin pivot 44 further to unloading station 47 where the finished collated sets are gripped by a gripper mechanism 48 which raises the finished collated sets above the level of the bin 43 thereby permitting the bin to be pivoted back to the collating position. Once the bin has been withdrawn from the unloading station 47 the gripper mechanism releases its hold on the finished collated set which then falls into collecting bin 51.

Figure 2:
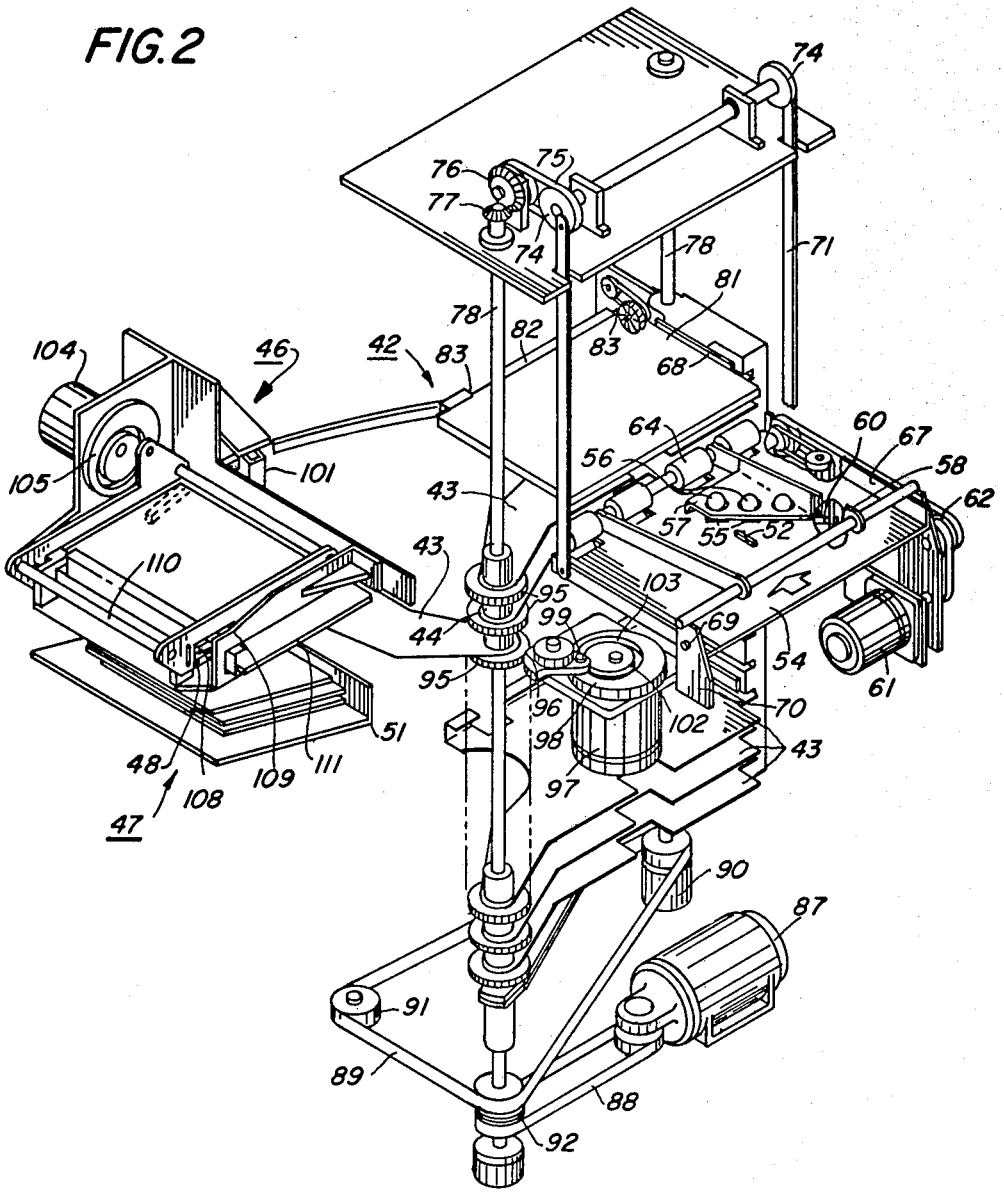
FIG. 2 is an isometric view from the front of the finishing station of the present invention.
Figure 3:
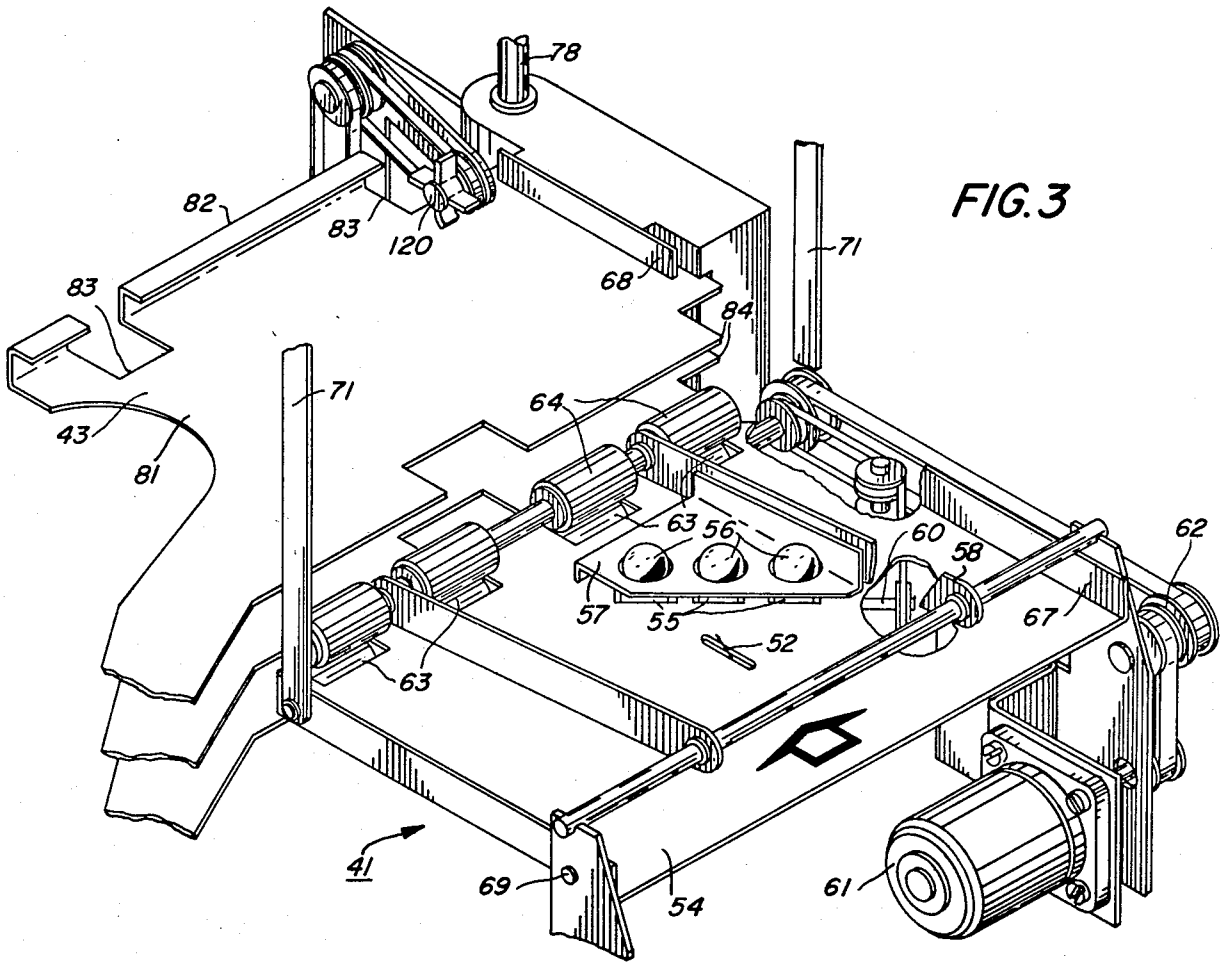
FIG. 3 is an enlarged isometric view of the edge registration transport with a single sheet collecting tray.

With continued reference to FIG. 2 and additional reference to FIG. 3 the finishing station according to the present invention will now be described in somewhat greater detail. When the first sheet is delivered from the processor of the reproduction machine it activates sensing switch 52 within the platform 54 of the edge registration transport 41 which activates the sequence of events in the entire finishing station. Mounted within the platform 54 of the edge registration transport 41 are three driven edge registration rolls 55 backed on the top by three idler rolls 56 mounted in plate 57 which is fixed to one of two side transport pivot arms 58. The edge registration rolls are driven by drive shaft 60 which is driven in turn off the transport motor 61 through the driver mechanism 62 at the side of the edge registration transport. Forward drive rolls 63 also mounted in the bottom of edge registration transport platform 54 are also driven by the transport platform motor 61 through driver mechanism 62 and together with idler roll 64 serve to drive the copy sheets into the bins 43. The edge registration rolls 55 serve to drive incoming copy sheets at an angle into side registration guide member 67 and subsequently against the bin side registration edge 68. The edge registration transport 41 is pivoted about pivot shaft 69 which engages with end plate 70 to enable the whole edge registration transport to toggle up and down for copy sheet insertion into the individual bins. The edge registration transport 41 moves up and down in toggling fashion for each sheet of copy paper through arms 71 on opposite sides of the transport which are mounted on cams 74 to thereby impart a vertical oscillatory motion. The arms 71 through cam 74 and drive belt 75 and gears 76 and 77 are driven by elevator screws 78 and in phase therewith to facilitate copy sheet insertion in each of the bins 43.

The individual bins 43 comprise a bin platform 81 with a bin side registration edge 68 and a front registration edge 82 which has two cut out portions 83 to enable the gripper mechanism to grip the collated sets in the bin when in the unloading station 47 as will be described later. The front registration edge 82 and side registration edge 68 form a corner up against which the individual copy sheets may be corner registered upon insertion in the bin. Furthermore, as the bins are pivoted to the finishing position the centrifugal force generated continues to urge the individual copy sheets into the corner. At the rear of the bin platform 81 there is another cut out portion 84 to enable the collated set in the bin to be stapled at stapling station 46 when the bins are pivoted counter clockwise to finish the sets contained within them.

The bins 43 are moved vertically as an array by bin elevator screws 78. Typically the sorting operation is commenced with the bins in the up or home position such that the bottom bin is adjacent to the exit portion of the edge registration transport. In this position as the first sheet of copy paper enters the edge registration transport it activates switch 52 which activates the elevator drive motor 87 which in turn through belts 88, 89 and pulleys 90, 91 and 92 drives elevator screws 78 to continuously lower the array of bins past the copy sheet entrance part of the edge registration transport. Once activated the bins continue to move down vertically while the registration transport 41 periodically toggles up and down. For each bin the registration transport 41 is raised up to its highest level by arms 71 to meet the bin in its downward path. Thereafter the registration transport 41 stops and slowly moves down along with the bin. The registration transport continues to toggle for each successive bin to provide a maximum time when the bin entrance and the registration transport exit are adjacent to each other to facilitate copy sheet insertion in the bin. The bins continue sorting until a copy sheet has been inserted in the last bin in the array. Bidirectional sorting may be achieved with a bidirectional motor so that copies of the next sheet in the set to be reproduced are inserted as the bins are driven upward by the motor 87. In this mode of operation the edge registration transport functions in the same manner by starting at the lowpoint of its cycle and moving up in unison with the bin for copy sheet insertion followed by the edge registration transport dropping down to its low position for copy sheet insertion in the next bin. After the sorting operation has been completed, the array of bins is returned to the home position from which the bins may then be sequentially moved to the finishing position.

Each of the bins is pivotally mounted on elevator screw 78 and has a gear 95 which engages segment gear 96 as it is lowered into position. When the bin pivot motor 97 is activated it drives cam 98 which through cam follower 99, pivots the bin through an arc to the stapling station 46. In the finishing operation each of the bins is sequentially pivoted to the stapler station where it comes to rest or dwells while the stapler head 101 is activated. The movement of the bin to the stapler head, its dwell there at the stapling position are controlled by cam 98 and the firing of the staple is activated by a switch 102 in the cam 98. Thus the cam 98 serves to pivot the individual tray to the stapling position; hold it there for the finishing; activate the stapler and finally to further swing the tray about elevator screw 78 to the unloading position.

When the bin is pivoted to the unloading position unloading cam switch 103 activates the unloading cam motor 104 which through unloading cam 105 activates the gripper mechanism 48 to unload the finished set of copy sheets. The gripper mechanism includes two toggled gripper members, the bottom member 108 being fixed, the top member 109 being movable. When the unloading cam raises the gripper bar 110 up it releases the claw of the upper gripper member 109 which grips the collated set of finished copy sheets and raises it above the front registration edge of the bin 43. While the set is held by the gripper mechanism above the bin the bin pivot motor 97 through cam 98 swings the bin in a return arc to a home position in the vertical array of bins. The unloading cam continues its forward cycle and once the bin has been withdrawn the gripper mechanism is lowered, the jaws 108, 109 opened and the finished collated set permitted to fall into collecting bin 51.

In this manner once the bin has been returned to the vertical array of bins the next bin is lowered down the elevator screw 78, has its associated gear 95 engage segment gear 96 and the above described stapling and unloading operation is repeated.

Figure 4:
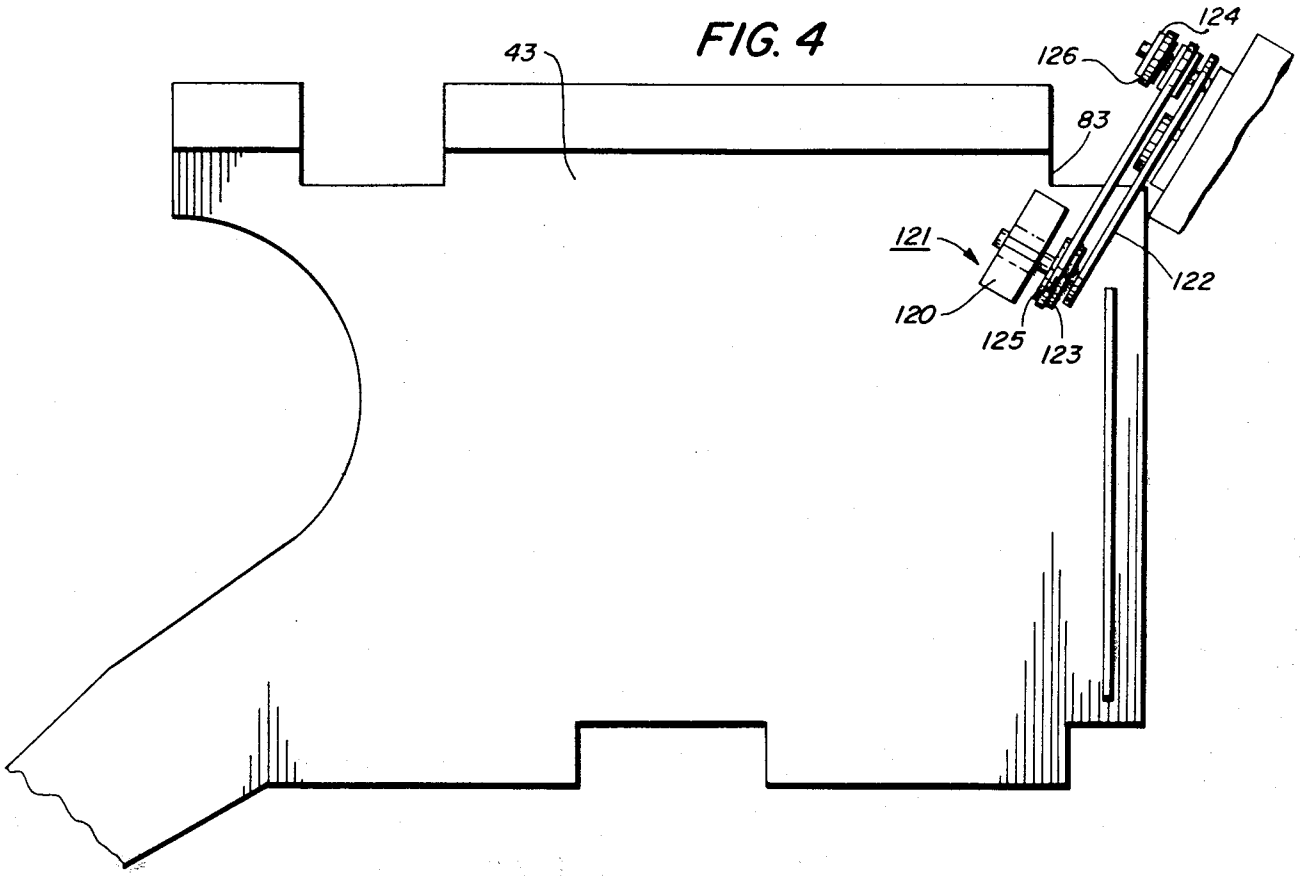
FIG. 4 is a top view of a corner registration device according to the present invention.
Figure 5:
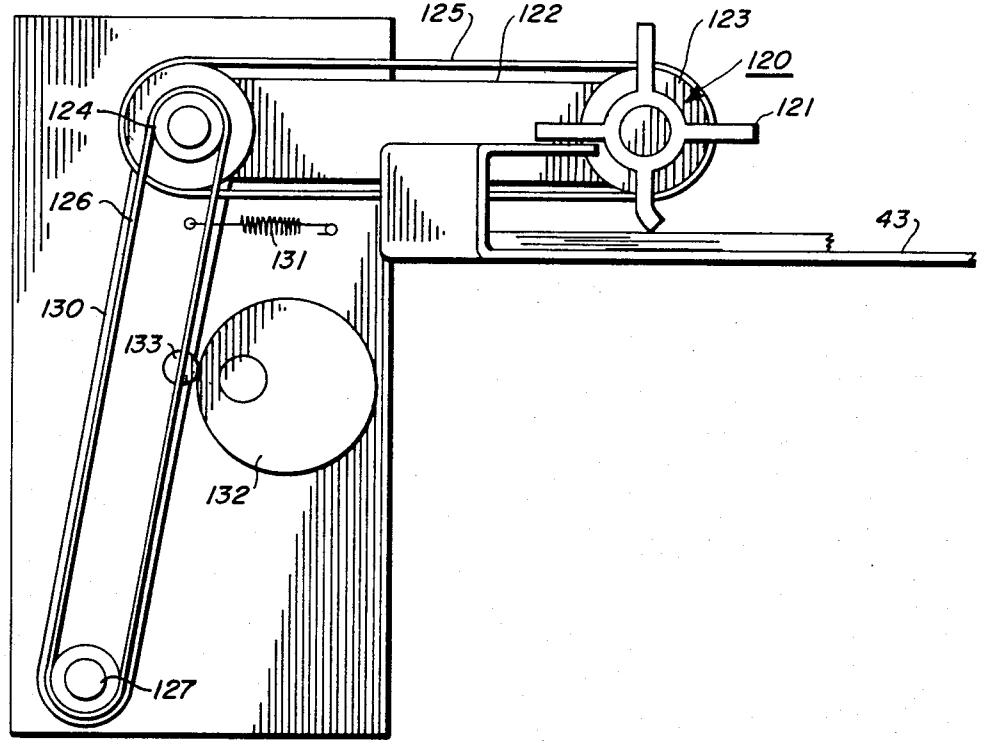
FIG. 5 is a side view of a corner registration device according to the present invention.

With particular reference to FIGS. 4 and 5 a device for corner registering copy sheets is illustrated. The device comprises a single paddlewheel assembly 120 which is mounted to the frame of the finishing station, the paddlewheel assembly being inserted and retracted into the registration corner 83 of a bin having a sheet inserted therein. The paddlewheel assembly 120 comprises paddle wheel 121 mounted on arm 122 and driven by belts 125, 126 around pulleys 123, 124 and 127 by motor, not shown. With particular reference to FIG. 5 the arm 124 is vertically supported by arm 130 which is urged toward the array of trays by spring 131. The placement of the paddlewheel is controlled by cam 132 and cam follower 133, the cam 132 being driven by the elevator motor 87 in synchronism with the bin. Thus as the array of bins is moved up or down the cam 132 is actuated to force the paddlewheel 121 out of the tray against the force of the spring 131. When the next tray arrives at the copy inserting station the cam 132 is rotated permitting the paddlewheel to be inserted in the tray into the corner to corner register the copy being inserted on both sides. In this way each copy sheet is simultaneously urged and registered against the bin side registration edge 68 and the bin front registration edge 82.

Figure 6:
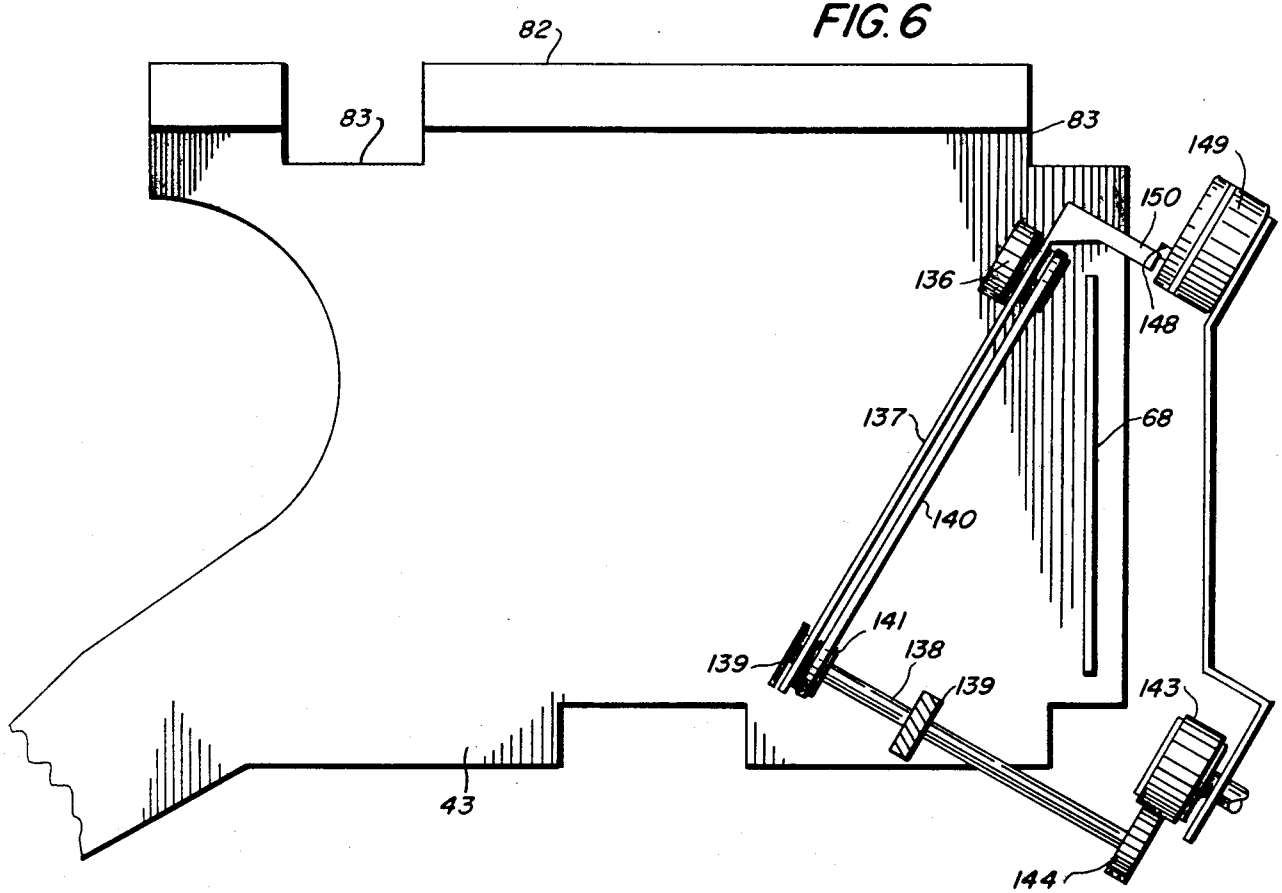
FIG. 6 is a top view of an alternative corner registration device.
Figure 7:
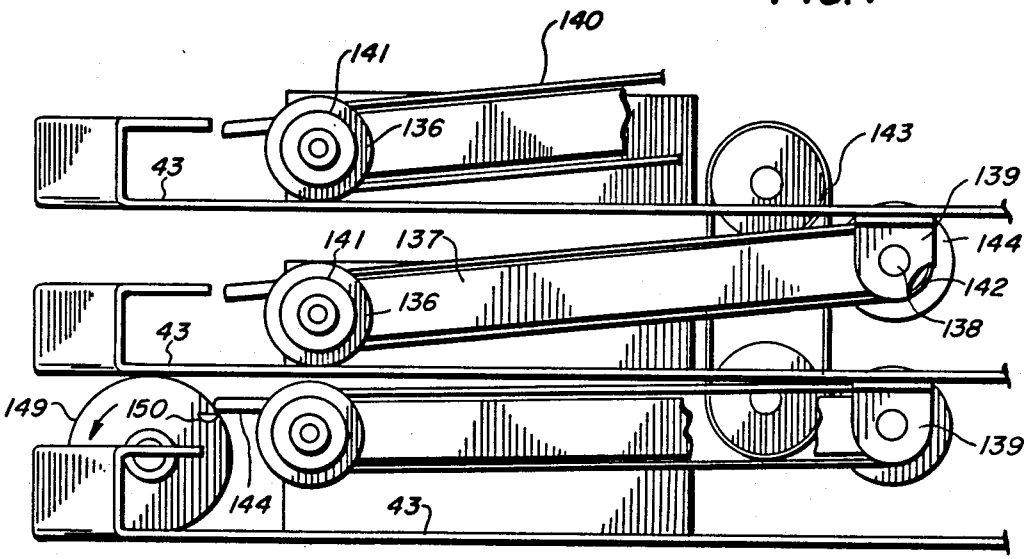
FIG. 7 is a side view of an alternative corner registration device.

FIGS. 6 and 7 depict an alternative embodiment of a device for corner registering copy sheets. In this embodiment a corner scuffer wheel 136 is placed in each bin to corner register the sheets as they enter the bin. The scuffer wheel is mounted on arm 137 which is pivotally supported through pivot shaft 138, the shaft 138 being pivotally fixed by brackets 139 to the bottom of the tray on top of the bin upon which it acts. The wheel 136 is driven by belt 140 through pulleys 141 and 142. The pivot shaft 138 in turn is driven by contact of pulley 144 with drive belt 143. The scuffing motion imparted to the wheel 136 continuously urges the copy sheets into front registration edge 82 and side registration edge 68. When the bin is pivoted in an arc from the sorting position to the stapling station the scuffer wheel is first raised off the sheets in the bin so as not to disturb registration. This may be accomplished by lifting pin 150 on rotary solenoid 149 contacting lift pin 148 on arm 137 and raising it together with the attached corner scuffer wheel off the copy sheet in the bin 43. It should be noted that only a single rotary solenoid is necessary since the bins swing from the sorting position to the stapling position from only a single position in the bin array. The belt 143 is positioned only at the sheet insertion station and thereby drives the pulley 144 and thereby the scuffer wheel only when a bin moves past the sheet insertion station.

In accordance with the invention a finishing station for a reproducing machine is provided. In particular a finishing station which collates, corner registers, and finishes sets of multipage original sheets into accurately registered and finished sets is provided. While the invention has been described with reference to specific embodiments it will be apparent to those skilled in the art that many alternative modifications or variations may be made by those skilled in the art. For example, while the finishing station has been illustrated as a stapler it should be noted that a stitching type of device could alternately be used. Accordingly it is intended to embrace all such alternatives and modifications as may fall within the scope of the appended claims.

We claim:

1. An output station for a reproducing machine comprising a sorter including a plurality of copy sheet collecting trays arranged in a vertical array, sheet transport means to transport copy sheets from the reproducing machine to the sheet sorter, said sheet transport having an entrance portion adjacent said reproducing machine and a sheet exit portion adjacent said sorter, said individual copy sheet collecting trays being mounted in a vertical array on an elevating means and including means to drive said elevating means vertically upwardly and downwardly past the sheet exit portion of said copy sheet transport to facilitate the sequential insertion of the copy sheet from the copy sheet transport to the individual trays, each of said copy sheet collecting trays also being pivotally mounted to said elevating means for individual pivotal movement about a vertical axis and further including means to sequentially swing said individual copy sheet collecting trays containing sets of collated sheets in an arc about said vertical axis from the sheet collecting position adjacent the sheet exit portion of said sheet transport to a finishing station, means to deliver finished sets of collated copy sheets to a finished set unloading station, said copy sheet collecting trays having means to corner register individual copy sheets as they are inserted in the individual copy sheet collecting trays and means to maintain the corner registration of the sets of collated sheets as they are transported from the sheet collecting position to a finishing station.

2. The apparatus of claim 1 wherein said means to corner register individual copy sheets includes vertical end portions on adjacent sides of the individual trays forming a corner registration means, and means to urge the individual sheets toward the corner registration means.

3. The apparatus of claim 2 wherein said means to urge the individual sheets toward the corner includes sheet transport means in the sheet transport from the reproducing machine to the sorter.

4. The apparatus of claim 2 wherein said means to urge the individual sheets toward the corner formed by the vertical end portions comprises a positively driven sheet aligner wheel.

5. The apparatus of claim 1 wherein said finishing station comprises a stapler.

6. The apparatus of claim 1 including means to reciprocate said exit portion of said copy sheet transport up and down in phase with the vertically moving trays to facilitate copy sheet insertion in said trays.

7. The apparatus of claim 6 further including means to swing said copy sheet collecting tray in an arc from said finishing station to a finished set unloading station.

8. The apparatus of claim 7 wherein said finished set unloading station includes means to securely grip said finished sets in said collecting tray and hold them while the collecting bin is removed from said unloading station.

* * * * *